US008213853B2

(12) United States Patent
Levin et al.

(10) Patent No.: US 8,213,853 B2
(45) Date of Patent: Jul. 3, 2012

(54) PRINTER SYSTEM AND METHOD FOR RECOVERY FROM A DOCUMENT ASSEMBLY FAILURE

(75) Inventors: Burton L. Levin, Lake Oswego, OR (US); James E. Owen, Vancouver, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 1191 days.

(21) Appl. No.: 11/725,712

(22) Filed: Mar. 20, 2007

(65) Prior Publication Data

US 2008/0229940 A1 Sep. 25, 2008

(51) Int. Cl.
*B65H 5/22* (2006.01)
*B65H 83/00* (2006.01)
*B65H 85/00* (2006.01)

(52) U.S. Cl. ..... 399/403; 271/3.03; 271/3.06; 271/3.09; 270/58.23; 270/25.04

(58) Field of Classification Search ..... 358/1.13, 358/1.14; 270/3.03, 3.06, 3.09, 52.04, 52.05, 270/52.08, 58.23; 101/2; 399/403, 407; 271/3.03, 3.06, 3.09
See application file for complete search history.

(56) References Cited

U.S. PATENT DOCUMENTS 4,317,203 A * 2/1982 Botte et al. ..... 714/51
5,080,348 A * 1/1992 Pendell et al. ..... 271/289
5,148,284 A * 9/1992 Nishikawa et al. ..... 358/296
5,547,177 A * 8/1996 Merkli et al. ..... 270/52.05
5,655,759 A * 8/1997 Perkins et al. ..... 270/52.02
5,818,470 A * 10/1998 Crowley ..... 346/136
6,224,048 B1 * 5/2001 Motamed ..... 270/52.02
6,443,058 B1 9/2002 Stadler ..... 101/23
6,633,990 B1 * 10/2003 Eisenberg ..... 713/400
6,707,563 B1 3/2004 Barry et al. ..... 358/1.14
7,034,951 B1 * 4/2006 Jones et al. ..... 358/1.12
7,287,748 B2 * 10/2007 Maeder et al. ..... 270/52.05
2003/0053114 A1 3/2003 Hopper ..... 358/1.15
2003/0095823 A1 5/2003 Maeda ..... 400/582
2004/0165016 A1 8/2004 Oyen ..... 347/12
2004/0252319 A1 * 12/2004 Gorp et al. ..... 358/1.13
2005/0168767 A1 * 8/2005 Moroney et al. ..... 358/1.14
2006/0103866 A1 * 5/2006 Saka et al. ..... 358/1.13
2006/0291018 A1 * 12/2006 Lang et al. ..... 358/540

* cited by examiner

*Primary Examiner* — Daniel J Colilla
*Assistant Examiner* — David Banh
(74) *Attorney, Agent, or Firm* — Law Office of Gerald Maliszewski; Gerald Maliszewski

(57) ABSTRACT

A system and method are provided for recovering from print assembly failure in a printer with printed medium assembly capabilities. The method generates a first print set including a plurality of physical medium sheets, and stores the first print set of a first interim stacker. A second print set is generated including a plurality of physical medium sheets. Sheets are accessed sheets from the first interim stacker and assembled with sheets from the second print set, generating a final print set with a plurality of sheets in a first order. The final print set is stored in an output stacker. In the event of a first print set failure, first print set replacement sheets are generating. In one aspect, generating the final print set includes directly merging first print set replacement sheets (bypassing the interim stacker) with sheets from the second print set.

14 Claims, 11 Drawing Sheets

PRINTER SYSTEM AND METHOD FOR RECOVERY FROM A DOCUMENT ASSEMBLY FAILURE

BACKGROUND OF THE INVENTION

1. Field of the Invention

This invention generally relates to printed document reproduction and, more particularly, to a system and method for printing documents with an improved ability to recover from document assembly failures.

2. Description of the Related Art

FIG. 1 is a schematic block diagram depicting a conventional printer with dual paper and print paths (prior art). The demands for higher speed printing are approaching a practical maximum in the throughput of the existing print engines, firmware, and paper path mechanisms. One solution for higher print throughput is to put two or more print engines together in a single cabinet such that they can be operated concurrently and independently, as shown.

The print engines can be identical, or of different speeds and capabilities. For example, to minimize the cost of having two color print engines in a single color printing system, one print engine can be limited to printing the sheets that are exclusively monochrome. Although the interim stacking bins are depicted as first in-first out (FIFO), in an alternate configuration (not shown) the bins may be last in-first out (LIFO).

Each printing engine has its own paper path and may run at different speeds. The problem of collating the final output can be resolved by keeping track of the page order of the sheets, stacking the printed pages in individual bins, and then merging the printed sheets just prior to putting the sheets into the output bin. There is no need to wait until the current job is finished in order to start a new job. Any print engine that has completed its printing can start printing sheets from the next job, even before the other engines have completed printing sheets from the current job.

FIG. 2 is a schematic block diagram depicting a specific failure mode associated with the hybrid printing systems of FIG. 1 (prior art). The problem concerns the recovery of pages when a failure occurs in the final assembly and output stacking of the document. Consider, for example, that each print engine stacks their printed pages in separate, interim bins awaiting the collation (merging) of the individual sheets into a single document for placing in the output bin. If a paper jam were to occur just prior to the final output stage (see FIG. 1), then one or all of the interim bins would have many already-printed pages. It is possible that one or all of the bins may have hundreds of printed sheets that cannot be outputted because the damaged sheets are missing. On the other hand, if just the damaged sheets are reprinted, they must somehow be advanced to the output bin before any additional drawing sheets are supplied from the interim bin(s).

Ideally, just the damaged pages are reprinted, and the print job can be continued without restarting the print job from page one. The problem, therefore, is to print and insert clean copies of the damaged sheets in the correct place within the final document, while saving the existing clean sheets already printed stored and in the temporary bins.

Conventionally, the problem is solved by requiring the user to throw out and reprint the pages not already in the output bin. To address this problem, some printer manufacturers build devices that print pages sequentially. First, all the pages from the color engine are printed, then the color-engine pages are inserted into the final bin in the required order as the monochrome engine is printing, making it feasible to halt the monochrome engine and have it re-print some pages if they get stuck in the path to the final bin.

Some of the above-mentioned printing problems also occur in printers employing a single print engine. Conventionally, when a paper jam or other failure occurs, all printing halts until the situation is remedied by human intervention. After the problem has been fixed, only then does the printing continue. Some of these problems could be solved without human intervention if a method of recovery was provided. Secondly, having the job halt until the problem is fixed creates an enormous inconvenience in having to restart the job at the point of failure. For example, if page 3 of a 500 page printout jams, the user will have to correct the problem, and then wait for 497 pages to print. If the printer could continue printing, or continue performing the bulk of the work before the paper jam was fixed, this would improve greatly the convenience of the printer.

Thus, for printers with multiple print engines as well as single print engine printers, it would be advantageous if a means existed for recovering a failed printer/collation job by reprinting just the damaged sheets.

SUMMARY OF THE INVENTION

One aspect of the present invention provides for a separate paper path from one or more of the engines, prior to the collection of printed sheets in interim paper bins. The separate paths connect directly to the output bin and allow for the reprinting of the damaged sheets, bypassing the interim bin. Then, the previously printed sheets already stored in the interim bins can be moved to the output bin. In this way, the sheet order within the document is maintained and the undamaged, previously printed, sheets are preserved for output as soon as the problem is resolved.

An intelligent controller recovery unit tracks the progress of each sheet through multiple parallel paper paths. A programmable controller is already a standard feature in complex copier-printers. The controller detects the failure of a sheet to reach a known location in a predictable time frame. The intelligent controller also tracks the position of every sheet in flight and/or in storage, such that it can direct each printed page to the appropriate interim or final bin. The controller directs the assembly of the final output by moving the appropriate printed sheet to the final bin. Electronic copies of the pages in process of being printed may be stored such that any specific page can be accessed for reprinting by one of several engines, depending on the specific configuration.

Accordingly, a method is provided for recovering from print assembly failure in a printer with printed medium assembly capabilities. The method generates a first print set including a plurality of physical medium sheets, and stores the first print set of a first interim stacker. A second print set is generated including a plurality of physical medium sheets. Sheets are accessed from the first interim stacker and assembled with sheets from the second print set, generating a final print set with a plurality of sheets in a first order. The final print set is stored in an output stacker. In the event of a first print set failure, first print set replacement sheets are generating. In one aspect, generating the final print set includes directly merging first print set replacement sheets (bypassing the interim stacker) with sheets from the second print set, and discarding any sheets that might be damaged in the first print set.

Some typical failures include a failure to generate initial first print set sheets, a failure to store first print set sheets in the first interim stacker, a failure to access first print set sheets from the first interim stacker, and a failure to supply undamaged first set print sheets.

In one aspect, first print set printing instructions are received from a source (e.g., a print driver) prior to printing, and generation of first print set replacement sheets includes determining sheets from the first print set that require reprinting, sending a replacement message to the source, and receiving printing instructions for the generation of the first print set replacement sheets.

In another aspect, the first and second print sets are generated from a first print engine. Alternately, the two first print sets can be generating from a different print engines. If two print engines are available, the first print set replacement sheets can be generated from the second print engine in response to a first print engine failure.

Likewise, the method may use more than one interim stacker. That is, the second print set may be stored in a second interim stacker, and the final print set generated by assembling sheets accessed from the first interim stacker, with sheets accessed from the second interim stacker. In the event of a second print set failure, the final print set can be generated by directly merging second print set replacement sheets with sheets from the first print set.

Additional details of the above-described method and a system for recovering from print assembly failure in a printer with printed medium assembly capabilities, are presented below.

DETAILED DESCRIPTION

Various embodiments are now described with reference to the drawings. In the following description, for purposes of explanation, numerous specific details are set forth in order to provide a thorough understanding of one or more aspects. It may be evident, however, that such embodiment(s) may be practiced without these specific details. In other instances, well-known structures and devices are shown in block diagram form in order to facilitate describing these embodiments.

As used in this application, the terms "component," "module," "system," and the like are intended to refer to a computer-related entity, either hardware, firmware, a combination of hardware and software, software, or software in execution. For example, a component may be, but is not limited to being, a process running on a processor, a processor, an object, an executable, a thread of execution, a program, and/or a computer. By way of illustration, both an application running on a computing device and the computing device can be a component. One or more components can reside within a process and/or thread of execution and a component may be localized on one computer and/or distributed between two or more computers. In addition, these components can execute from various computer readable media having various data structures stored thereon. The components may communicate by way of local and/or remote processes such as in accordance with a signal having one or more data packets (e.g., data from one component interacting with another component in a local system, distributed system, and/or across a network such as the Internet with other systems by way of the signal).

Various embodiments will be presented in terms of systems that may include a number of components, modules, and the like. It is to be understood and appreciated that the various systems may include additional components, modules, etc. and/or may not include all of the components, modules etc. discussed in connection with the figures. A combination of these approaches may also be used. It should be understood that software code stored in memory can be understood to be a computer-readable medium, or a signal bearing medium tangibly embodying a program of machine-readable instructions executable by a digital processing device.

Figure 1:
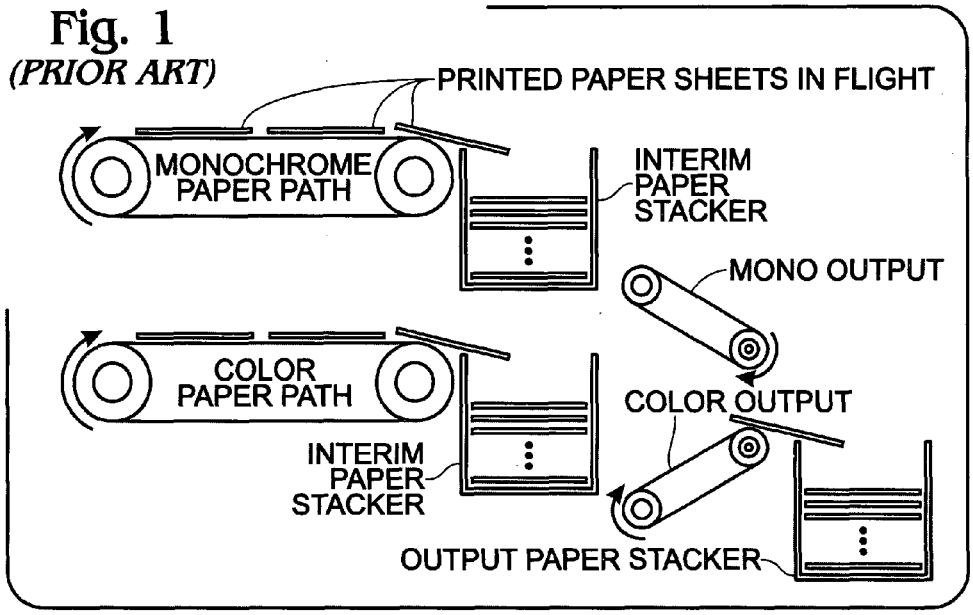
Fig. 1 (PRIOR ART)
FIG. 1 is a schematic block diagram depicting a conventional printer with dual paper and print paths (prior art).
Figure 2:
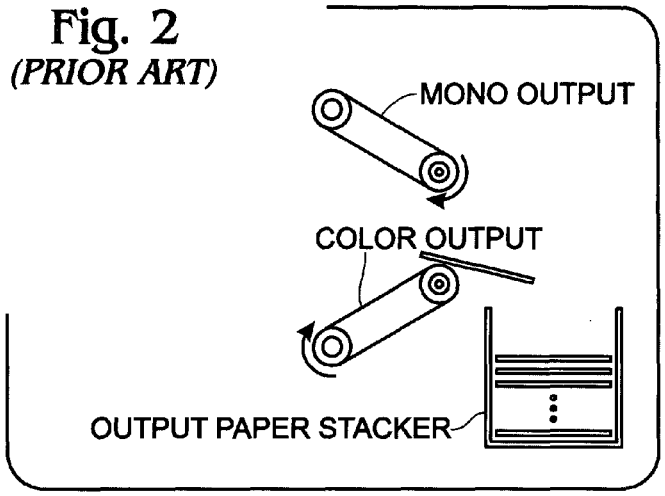
Fig. 2 (PRIOR ART)
FIG. 2 is a schematic block diagram depicting a specific failure mode associated with the hybrid printing systems of FIG. 1 (prior art).
Figure 3:
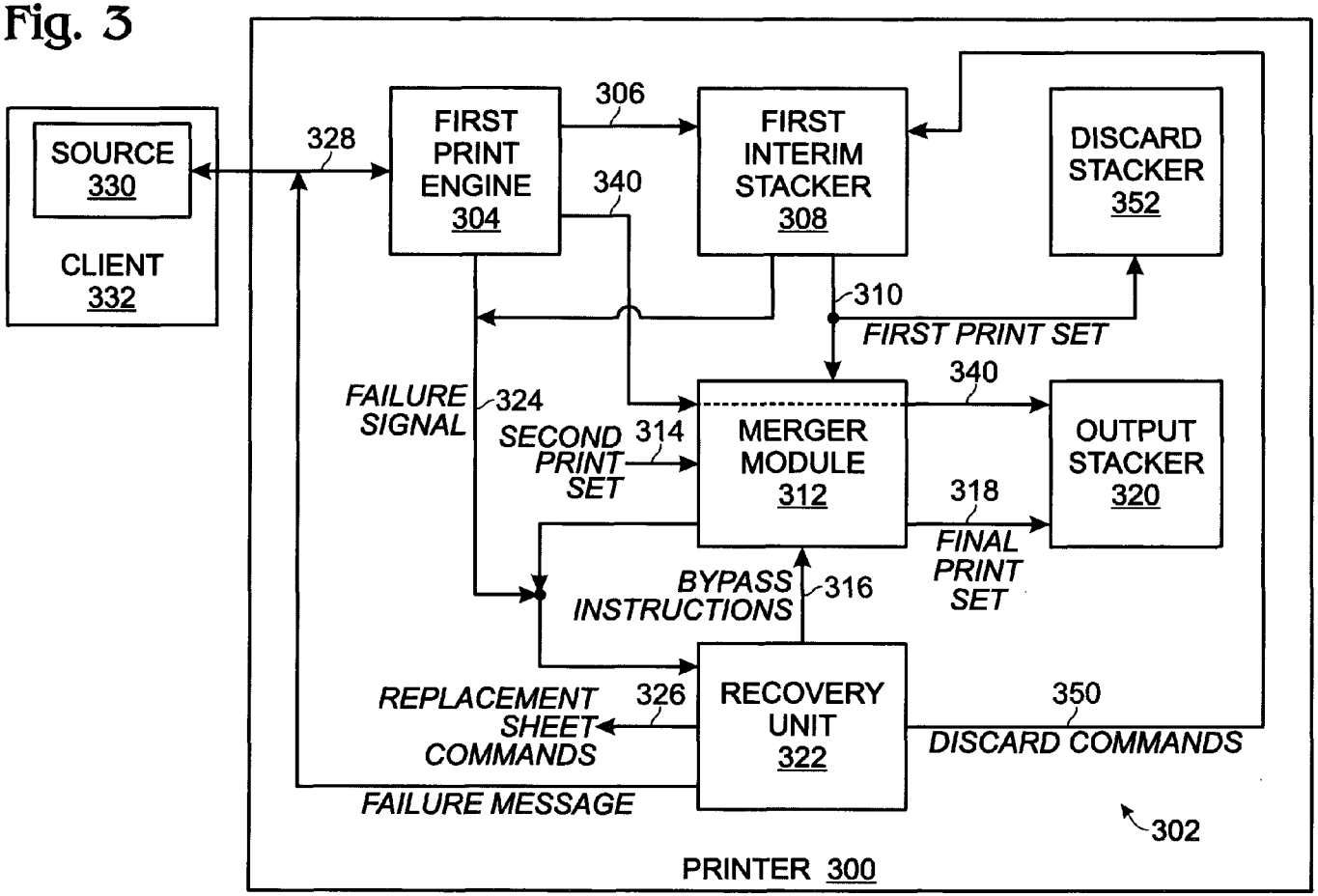
FIG. 3 is a schematic block diagram of a system for recovering from print assembly failure in a printer with printed medium assembly capabilities.

FIG. 3 is a schematic block diagram of a system for recovering from print assembly failure in a printer 300 with printed medium assembly capabilities. The system 302 comprises a first print engine 304 having an output paper path 306 to supply a first print set including a plurality of physical medium sheets. Paper is the primary example of a physical medium, however, there are other physical media that are printable. As used herein, a "printer" is a peripheral or standalone device that prints on a physical medium such as paper. A printer may incorporate other functions, such as scanning, faxing, or copying.

A first interim stacker 308 has an input connected to paper path 306 to accept the first print set from the first print engine 304 and an output connected to paper path 310 to supply the first print set. If the first interim stacker is a LIFO device, the output order of the interim stacker is reversed or different from the input. Alternately, if the first interim stacker is a FIFO device, the input and output orders are the same. A merger module 312 has an input on paper path 314 to accept a second print set including a plurality of physical medium sheets, and an input connected to paper path 310 to access sheets from the first interim stacker 308. The source of the second print set is not explicitly shown. In one aspect, the source of the second print set may be the first print engine 304. Alternately, the source may be a second print engine (not shown). The merger module has an input to accept bypass commands on line 316. The merger module 312 assembles sheets accessed from the first interim stacker 308, with sheets from the second print set, and supplies a final print set with a plurality of sheets in a first order via paper path 318.

An output stacker 320 has an input connected to paper path 318 to accept the final print set. A recovery module 322 has an input on line 324 to accept a failure signal, an output on line 326 to supply replacement sheet print commands to a print engine, and an output on line 316 to supply bypass instructions to the merger module 312 in the event of a first print set failure. If there is only one print engine, the replacement sheet commands on line 326 would be sent to the first print engine 304. Alternately, if the printer 300 includes more than one print engine, the replacement sheet commands may be sent some, or all of the print engines. The merger module 312 directly merges first print set replacement sheets, with sheets from the second print set, in response to the bypass instructions on line 316.

In one aspect as shown, the first print engine 304 has an output on line 324 connected to a recovery unit 322 input to supply a print failure signal. The first interim stacker 308 has an output on line 324 connected to the recovery unit 322 input to supply a storage failure signal. Further, the merger module 312 has an output on line 324 connected to the recovery unit 322 input to supply an access failure signal. Then, the recovery unit 322 is able to supply first print set replacement sheet commands on line 326 and bypass commands on line 316 in response to one of the following failure signals: a failure to initially generate first print set sheets; a failure to store first print set sheets in the first interim stacker 308, a failure to access first print set sheets from the first interim stacker 308, or a failure to supply undamaged first print set sheets. The commands may be supplied by units 304, 308, or 312.

In another aspect as shown, the first print engine 304 has an input on line 328 to receive first print set printing instructions from a first source 330. The first source 330 may be a software application or print driver microprocessor instructions embedded in the memory of a client terminal 332, such as a PC, working in cooperation with an operating system, which is also stored in memory. Line 328 may represent a local, network, or a combination of local and network connections. The invention is not limited to any particular type of network, physical medium, or communication protocol. The network may be a LAN, WAN, or Internet, for example. Line 328 may represent wired, wireless, or combination of connections. A local connection may be enabled with a USB, serial, or parallel port interface, for example. In some aspects (not shown), a server may act as an interface between the client terminal 332 and the printer 300. The first source 330 supplies printing instructions in a printer language format (e.g., PDL) that is compatible with the printer 300.

The recovery module 322 determines sheets from the first print set that require reprinting in response to receiving a failure signal, and sends a failure message to the first source 330. As an alternative to the recovery unit 322 sending printing instructions in the replacement sheet commands on line 326, the original source of the printing instructions can be used. In response, printing instructions are received from the first source 330 for the generation of the first print set replacement sheets.

In a different aspect, the merger module 312 includes a bypass path 340 having an input, and an output connected to the output stacker 320, for sending first print set replacement sheets directly from a print engine output (e.g. the first print engine 304 as shown) to the output stacker 320, bypassing the first interim stacker 308.

In another aspect, the recovery unit 322 supplies discard commands on line 350 in response to a signal indicating a failure to supply undamaged first print set sheets. For example, damaged sheets may be bent or improperly marked. Then, a discard stacker 352 has an input connected to the first interim stacker output via paper path 310 for the storage of damaged first print set sheets. The first interim stacker 308 has an input to accept the discard commands on line 350. The first interim stacker 308 supplies damaged first print set sheets to the discard stacker 352 in response to the discard commands. In another aspect not specifically shown, discard commands may also be sent to the first print engine 304, and the first print engine can directly supply damaged first print set sheets to the discard stacker in response to discard commands.

Figure 4:
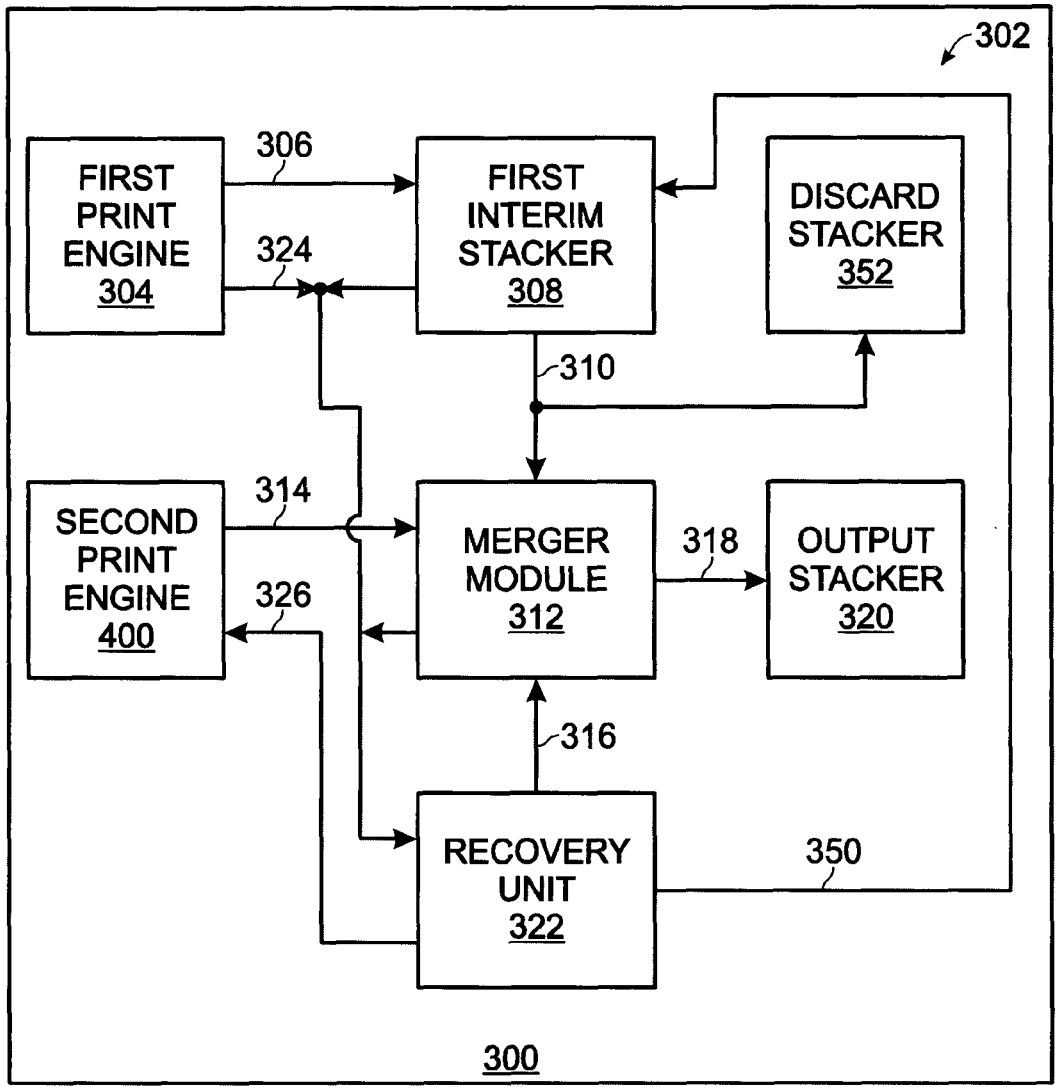
FIG. 4 is a schematic block diagram depicting a first variation of the recovery system of FIG. 3

FIG. 4 is a schematic block diagram depicting a first variation of the recovery system of FIG. 3. As noted above in explaining FIG. 3, the first print engine 304 may supply the first and second print sets. Alternately as shown in FIG. 4, a second print engine 400 has an output connected to paper path 314 to supply the second print set. In one aspect, the recovery unit 322 supplies first print set replacement sheet commands on line 326 in response to a failure to generate first print set sheets (in response to receiving a failure to initially generate first print set sheets from the first print engine on line 324). The second print engine 400 has an input connected to the recovery unit output on line 326. Then, the second print engine 400 supplies first print set replacement sheets in response to first print set replacement sheet commands from the recovery unit 322. Note, replacement sheet commands may, in some aspects not shown, also be sent to the first print engine 304.

Figure 5A:
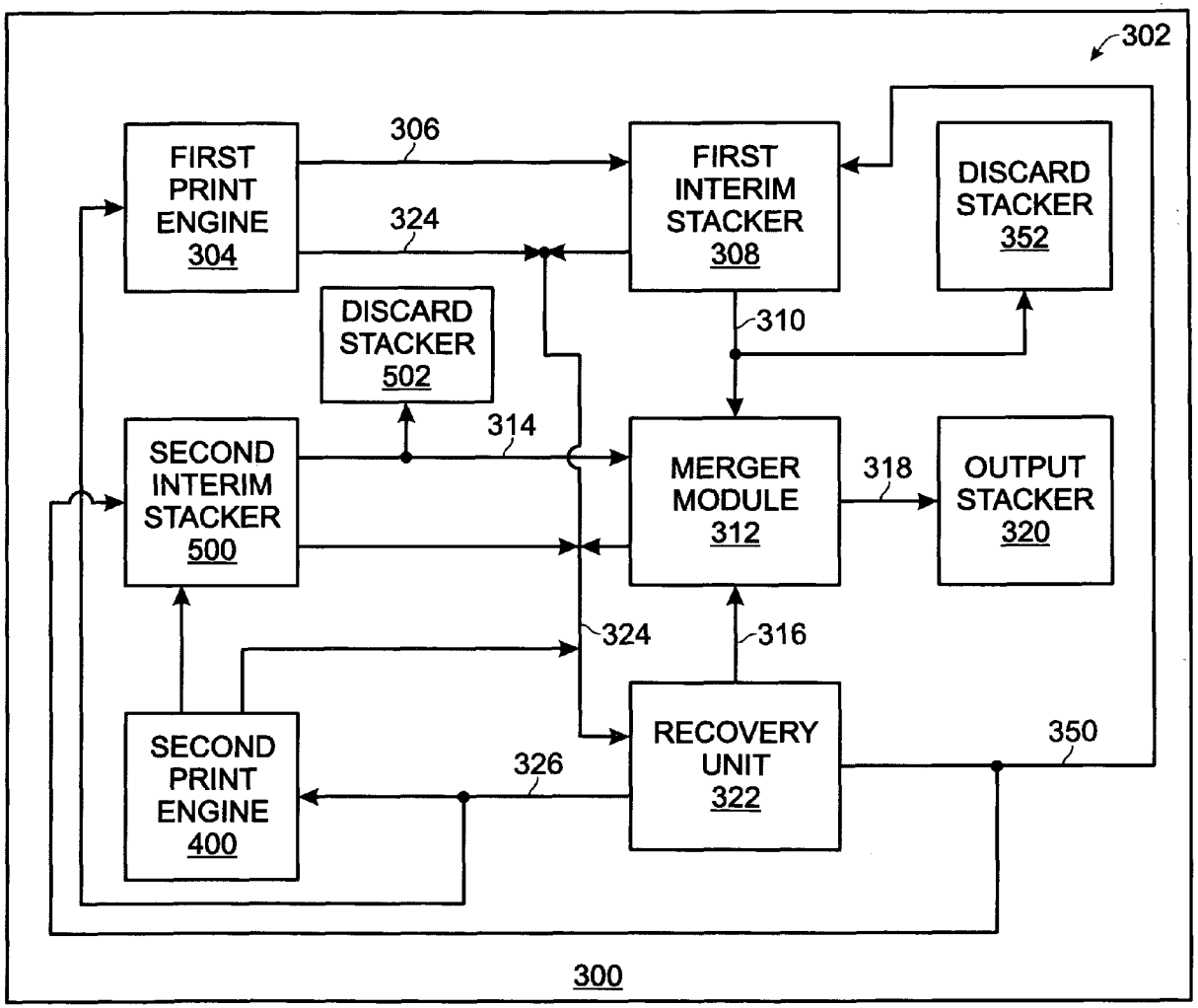
FIGS. 5A and 5B are schematic block diagrams depicting a second variation of the recovery system of FIG. 3.
Figure 5B:
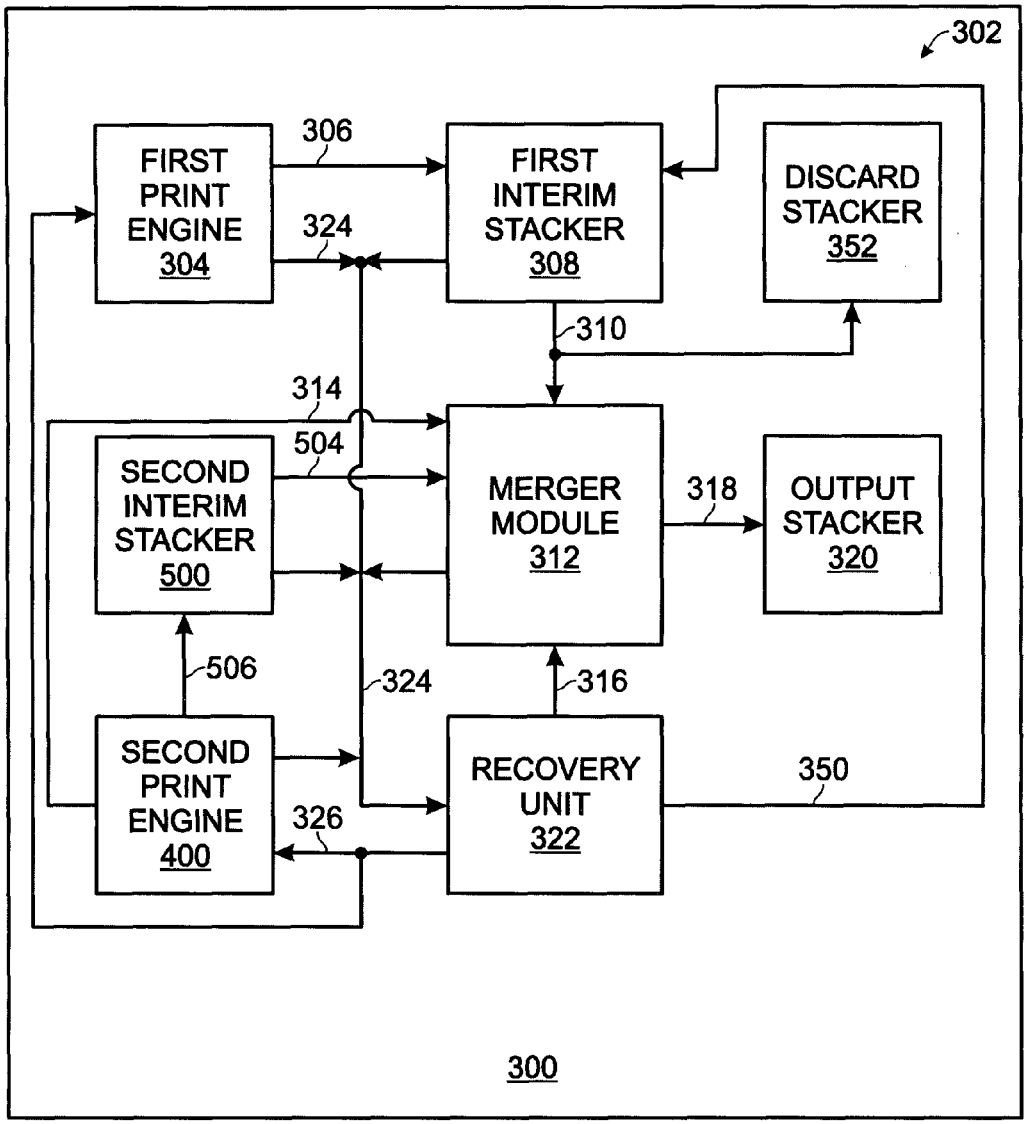

FIGS. 5A and 5B are schematic block diagrams depicting a second variation of the recovery system of FIG. 3. The system 302 of FIG. 5A includes a second interim stacker 500 having an output connected to paper path 314, to supply the second print set. The merger module 312 has an input connected to the second interim stacker output via paper path 314. The merger module 312 supplies the final print set by accessing sheets from the second interim stacker 500, and assembles sheets accessed from the first interim stacker 308, with sheets accessed from the second interim stacker 500.

In one aspect, the second interim stacker 500 has an output connected to the recovery unit input on line 324 to supply a storage failure signal. In addition to the failure signals described above in the explanation of FIG. 3, the recovery unit 322 is able to supply second print set replacement sheet commands on line 326 and bypass commands on line 316 in response to receiving one of the following failure signals: a failure to generate second print set sheets, a failure to store second print set sheets in the second interim stacker 500, a failure to access second print set sheets from the second interim stacker 500, and a failure to supply undamaged second print set sheets. Then the merger module 312 is able to directly merge second print set replacement sheets, with sheets from the first print set, in response to the bypass instructions.

In another aspect, the recovery unit 322 supplies discard commands on line 350 to second interim stacker 500. A discard stacker 502 has an input connected to the second interim stacker output via paper path 314 for the storage of damaged sheets. The second interim stacker 500 has an input to accept the discard commands on line 350. The second interim stacker 500 supplies damaged sheets to the discard stacker 502 in response to the discard commands. In another aspect not specifically shown, discard commands may also be sent to the second print engine 400, and the second print engine can directly supply damaged sheets to either discard stacker 500 or discard stacker 352 in response to discard commands. Since the order of the discarded pages is irrelevant, the discard stackers 500 and 352 may be combined into one (not shown).

In FIG. 5B, the system 302 operates in a manner similar to the variation of FIG. 3, with the first print set from the first interim stacker 308 being directly merged with a second print set on line 314, which is not temporarily stored. In this aspect, the second interim stacker 500 is used for temporary storage in failure situations. The recovery module 322 supplies replacement sheet commands on line 326 in response to a failure signal, for generating replacement sheets for the entire first print set and storing the replacement sheets in the second interim stacker 500. The second interim stacker 500 supplies the replacement sheets to the merger module via paper path 504. As an example, the replacement sheets may be supplied from the second print engine 400 via paper path 506. The merger module 312 directly merges first print set replacement sheets from the second interim stacker 500 (instead of the first interim stacker 308) with sheets from the second print set. For example, this method would be used if there was a problem with the printer supplying the first interim stacker, with the storage of the first print set in the first interim stacker 308, or in accessing the first interim stacker.

Figure 6A:
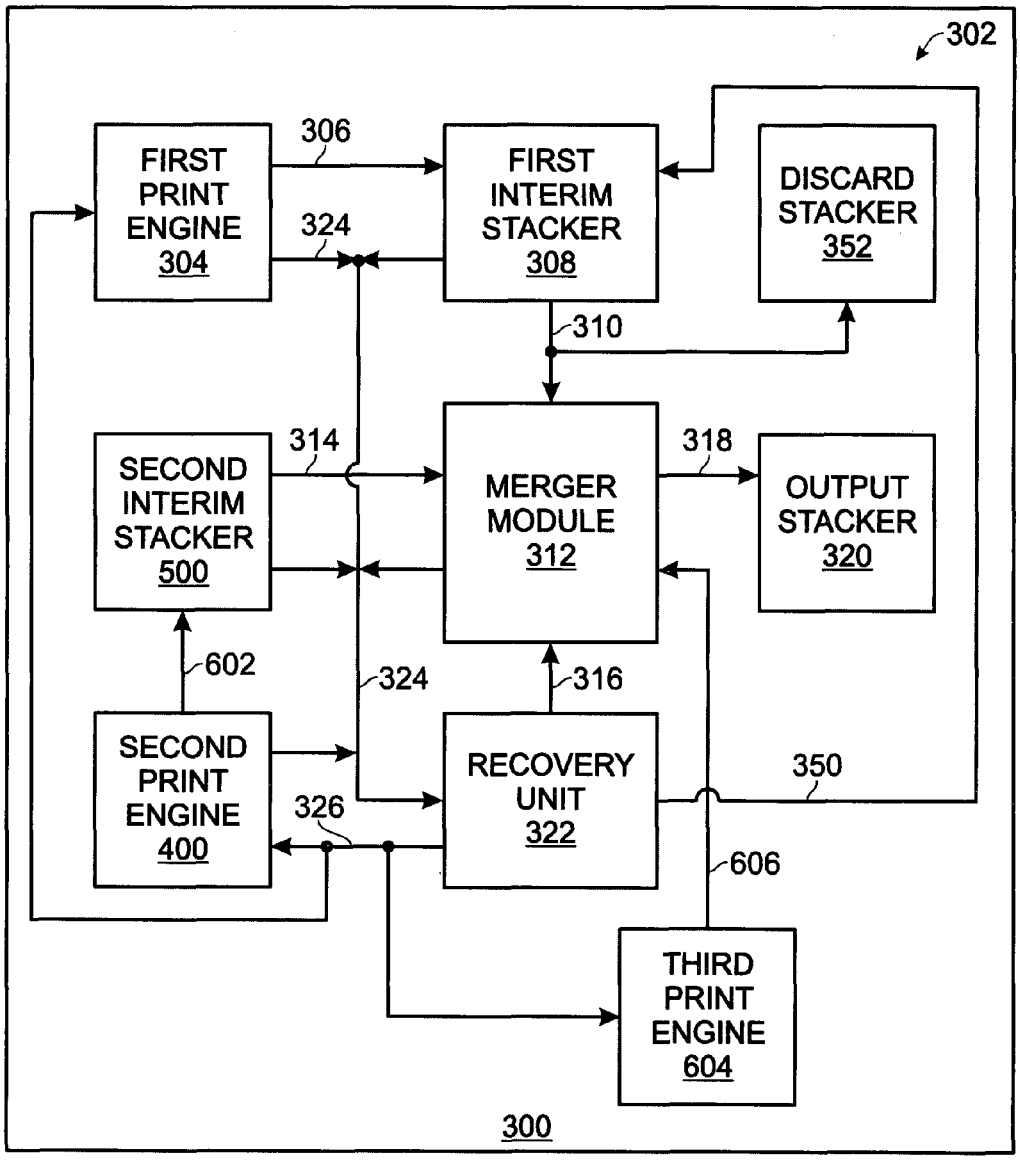
FIG. 6A is a schematic block diagram depicting a variation of the recovery system of FIG. 5A.

FIG. 6A is a schematic block diagram depicting a variation of the recovery system of FIG. 5A. In this aspect, the second print engine 400 has an output connected to paper path 602 to supply the second print set, and an output on line 324 to supply a print failure signal to the recovery unit 322. If the recovery unit 322 receives a print failure signal from the second print engine 400, the second print set replacement sheets may be generated using the first print engine 304. Alternately, a third print engine 604, having an input on line 326, may receive second print set replacement sheet commands from the recovery unit 322, and an output connected to the merger module 312 via paper path 606 may supply second print set replacement sheets.

Figure 6B:
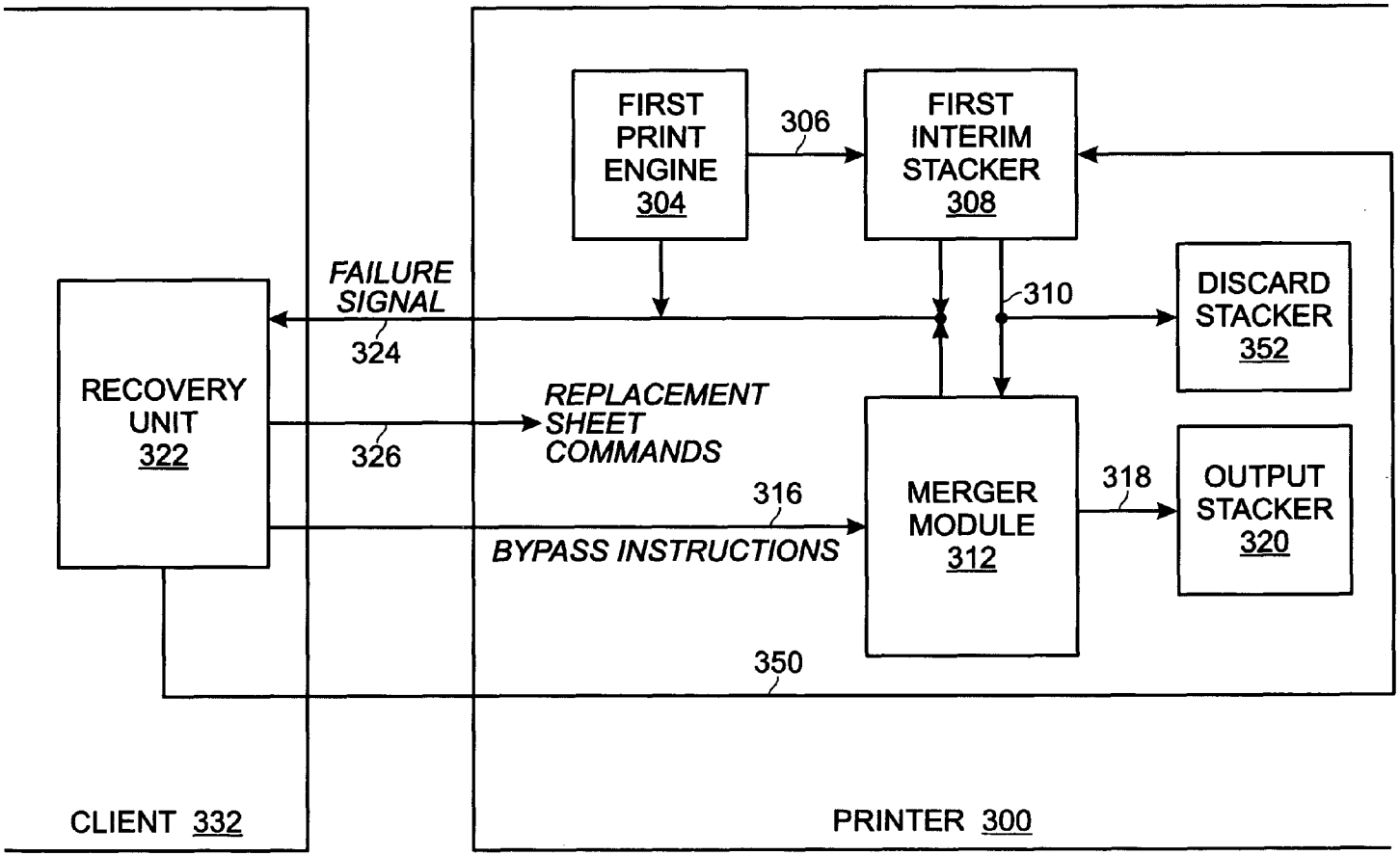
FIG. 6B is a schematic block diagram depicting a recovery system with the recovery unit embedded in a client device.

FIG. 6B is a schematic block diagram depicting a recovery system with the recovery unit embedded in a client device. The system 302 is similar to the system of FIG. 3 expect that the printer 300 includes a port to receive bypass instructions (line 316), discard commands on line 350 (in some aspects), and replacement sheet commands (line 326). The port also supplies failure signals on line 324. The client may be locally or network connected. The "client" may also be a network-connected server. Further, the client may be the original source of the printing job being supplied to the printer. The client recovery module 322 accepts the failure signal, and has outputs to supply replacement sheet print commands and bypass instructions to the merger module 312 in the event of a first print set failure.

Functional Description

This above-described system reprints copies of pages that are damaged as they traveled through the final paper path, salvages already printed pages, and assembles the pages of the document in the correct sequence for final output. While examples are provided that only consider system with a limited number of print engines and paper paths, it should be understood that a variety of configurations and redundancy that could be implemented using the demonstrated methodology to achieve the twin goals of high speed and high availability.

Figure 7:
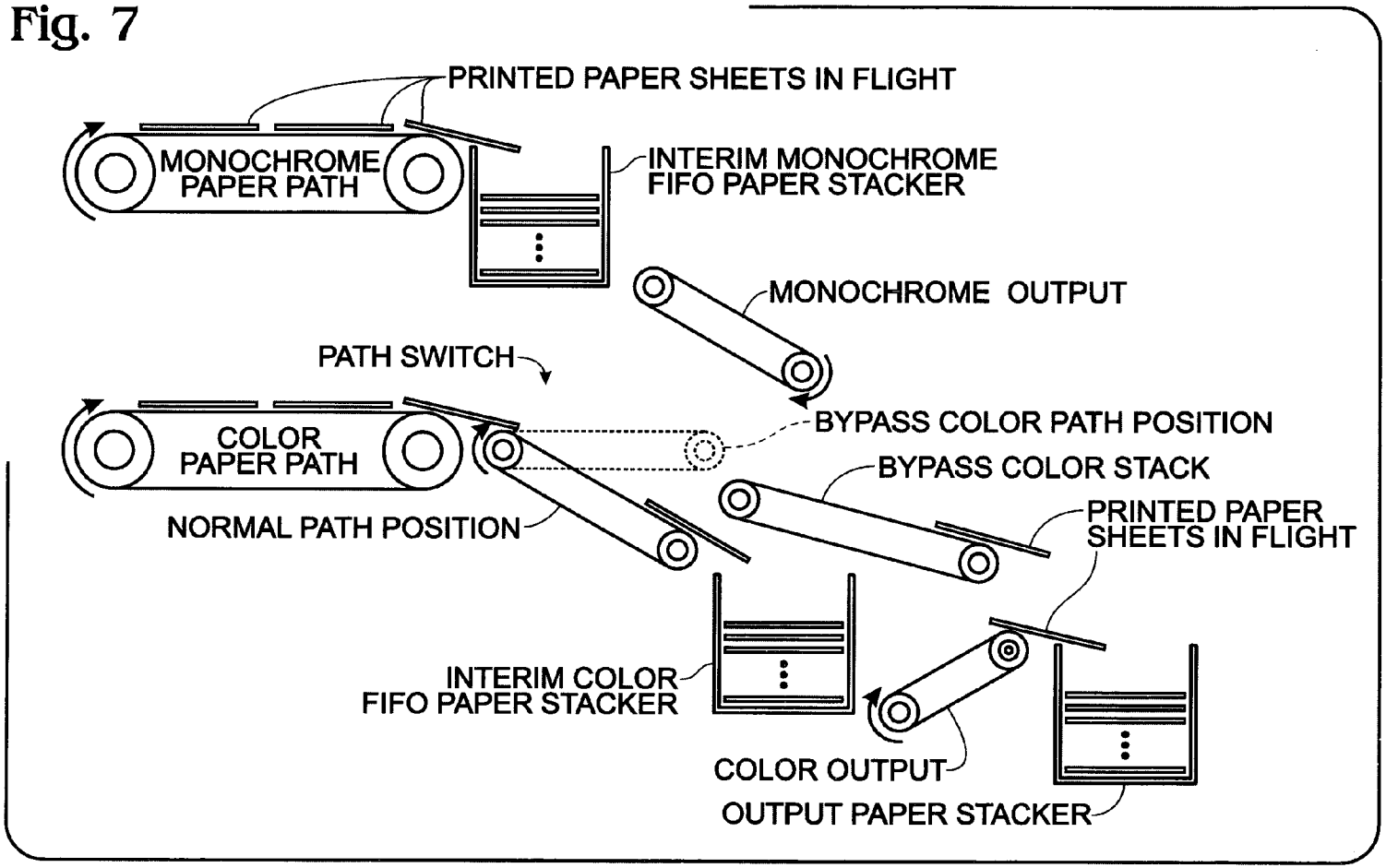
FIG. 7 is a schematic block diagram depicting a recovery system in a hybrid printer with color and monochrome print engines.

FIG. 7 is a schematic block diagram depicting a recovery system in a hybrid printer with color and monochrome print engines. A hybrid system is composed of two or more printing mechanisms (engines), each of which prints individual pages of a document at rates that are different from one another. The term 'hybrid printer' refers to a single device (box) with multiple printing engines. Not all engines need be identical, e.g., one or more engines may print in color and one or more engines may only print in monochrome. The different engines may even have other differing characteristics, such as print speed. The different engines share the same network interface, although the internal print engines may be separately addressable by a network-connected device that is sending the job.

In order to keep each engine fully utilized, the printed pages for each document are temporarily stored in interim FIFO bins. In this way, one engine may completely print all the pages assigned to it while the other engine is still printing its pages. If the first engine has printed all the pages assigned to it for the original document, it can start printing pages for the next job in sequence.

Separate paths are provided from one or more of the engines, to the interim paper bins. The separate paths connect directly to the output bin and allow for the reprinting of the damaged sheets, bypassing the interim bin. Then, the previously printed sheets already stored in the interim bins can be moved to the output bin. In this way, the sheet order within the document is maintained and the undamaged, previously printed, sheets are preserved for output as soon as the problem is resolved.

Figure 8:
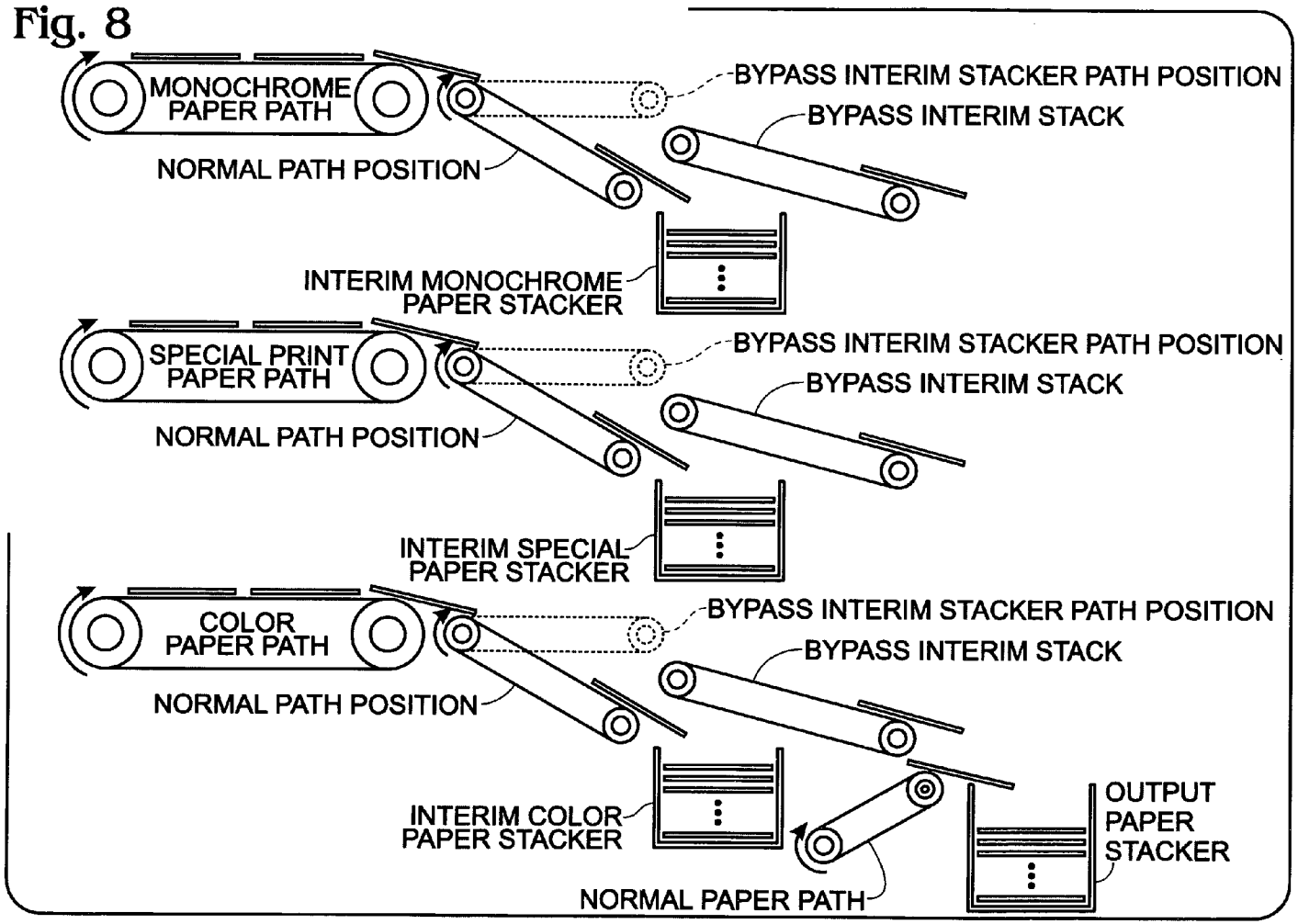
FIG. 8 is a schematic block diagram depicting a recovery system in a printer with greater than two heterogeneous print engines.

FIG. 8 is a schematic block diagram depicting a recovery system in a printer with greater than two heterogeneous print engines. With the inclusion of independent paper paths, including bypass paths, and an intelligent controller having the capability of redirecting images for printing, the system has several unique features. Already-printed pages may be recovered. The original page order of the printed document can be maintained. The recovery can be performed quickly. Further, the system is highly available, meaning that when one print engine fails, has a paper jam, or runs out of ink or toner, the other print engines can continue to print. Because there is an intelligent controller or recovery unit, whenever a failure occurs, print images can be redirected dynamically from the problem subsystem to one of the other print subsystems.

Proper design of the interlocking system would permit a user to fix the problem while the other subsystems continue to operate at full speed. When a print subsystem completes the printing of all the images assigned to it for the current job, it can start on the next job without waiting for the current job to be completed by the other subsystems.

Figure 9:
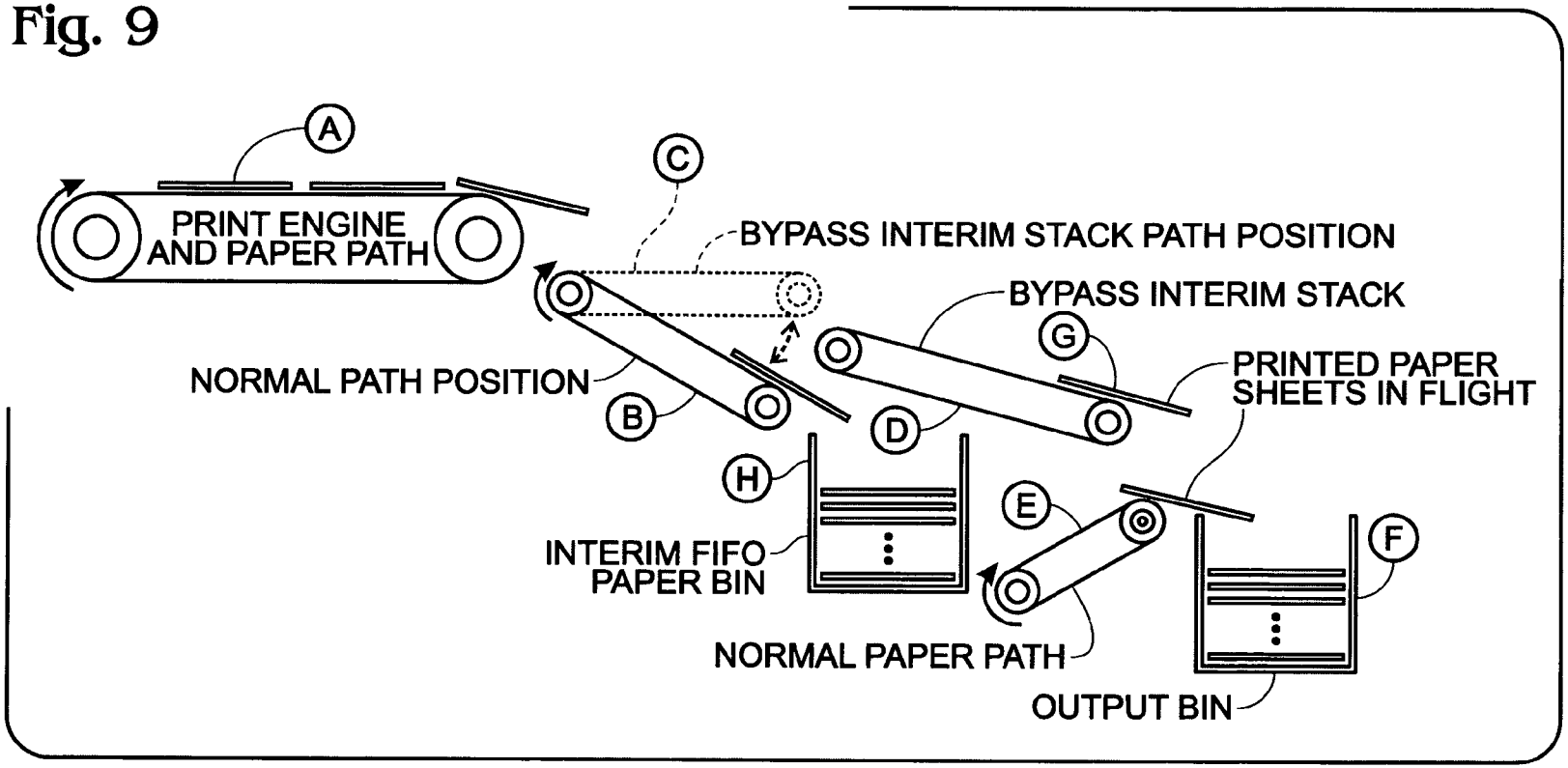
FIG. 9 is a schematic block diagram describing the bypass operations of the recovery system in greater detail.

FIG. 9 is a schematic block diagram describing the bypass operations of the recovery system in greater detail. The system addresses the recovery from a failure in the path starting from a page or sheet exiting the print mechanism of any print engine, and ending with the final output of a page, i.e., the path 'H', 'E', 'F' in the figure.

Assembly of the document requires that each individual page be removed from the appropriate interim bin and sent to the final output bin in the correct sequence. The mechanisms illustrated in the figure can exist attached to only one print engine, or the mechanisms can be duplicated and attached to additional print engines as required. Choice of which recovery path to use is under the control of the recovery unit software.

There may be many pages in different places, traveling through the print and assembly mechanisms. For purposes of simplicity, the additional interim bins and paper paths are not shown, but are assumed to be present. See FIGS. 7 and 8 for an illustration of recovery configurations using multiple interim bins. Note that the path depicting an interim bin for duplex printing is not illustrated for this discussion.

Beginning at the section labeled 'A', pages travel through and exit the print engine onto the path labeled, 'B'/'C', which is the same physical roller in different positions. From this point forward, the page may travel in one of the two directions: (1) the normal operative mode 'B' or; (2) a bypass path, 'C', for moving copies of the damaged pages to the correct position for the final document assembly.

Normal Operative Path

The roller carrying the page from the print engine is normally in the position labeled 'B'. In this position the roller deposits the printer page into the interim FIFO bin, 'H', putting the page on top of the stack of pages previously printed. The roller labeled 'E' removes a page from the bottom of the stack in bin, 'H', and moves it to the Output bin, labeled 'F'.

An intelligent controller, also referred to herein as a recovery unit, keeps track of all the pages as they are printed and in motion. It can initiate the picking of a page from any of the interim FIFO bins. In this manner, an embedded microcontroller sequences the pages of the document, placing the pages into the final output bin, 'F' in the correct order.

Because there are sensors at each stage of the paper path, the controller can also detect the failure of any page to reach a particular position. This failure conventionally signals a failure to pick a page from an input bin or interim bin, or is an indication of a paper jam. To recover in the event of a failure (e.g., paper jam), the controller may keep a complete copy of every printed page in a storage mechanism, such as a disk for example.

Recovery From Failure

The following discussion focuses on a failure in the final document assembly and output stacker path, or somewhere in the path labeled 'H', 'E', and 'F'. Detection of a failure in the path labeled 'H', 'E', and 'F' requires the reprinting of the damaged or lost pages. At this point, the roller mechanism is rotated from position 'B' to position 'C'. The intelligent controller locates the page to be reprinted and pulls the image from the storage in memory. The controller then reprints the page, directing the page to the path 'C', 'D', 'G', 'F', thereby, sending the page directly to the output bin 'F'. When the damaged page(s) have been reprinted and are in the output bin, the roller mechanism moves back to position 'B' and normal printing and document assembly is continued.

Assuming that there is more than one bypass mechanism, if the failure is at 'B', the system may reprint the pages using a different bypass. The intelligent controller cannot distinguish between a failure to pick the next page from the FIFO bin, from a paper jam. Nor does it have to. In either case, one or more pages are reprinted and the correct pages are selected.

Example Configurations

Examples are presented below of different configurations of controllers, print engines, and paper paths. This is not intended to be an exhaustive list of configurations. In most cases, the recovery system can be managed using only one bypass. A second path can be included to add high availability to the print system. However, if the system is using separate controllers, or print engines with special (non-universal) capabilities, additional bypass paths may be required.

The number of controllers determines whether a given page to be re-printed can be printed by any engine, or whether it must be printed on the same engine on which it was originally printed. If the system is using a single controller to rip and store all the pages, then fewer bypass paths are needed. If each print engine is bundled with it's own controller to rip and store only the pages it prints, then each engine needs its own recovery path. Providing each engine with its own bypass improves the availability of the system. For example, if one path is unavailable, then alternate bypass paths can be used.

If all the engines are identical, then the system can use a single recovery path (assuming a single controller). If the engines are different in capabilities, for example some are color and some are b/w, then it suffices to have the recovery path from the most capable engine. Lastly, if there are printers with unique capabilities, they must have a separate bypass path.

Referring again to FIG. 7, the addition of a switch and a bypass path for the Color Engine may be implemented, such that the printed sheet can be directed to the interim bin in the normal mode or directed onto the bypass path, going directly to the output bin for pages printed out of order (recovery mode). The bypass is attached to the Color Engine because it can print both monochrome and color.

Referring again to FIG. 8, each engine has its own path and bypass switch, providing the greatest flexibility and availability in recovering from a paper jam.

Figure 10:
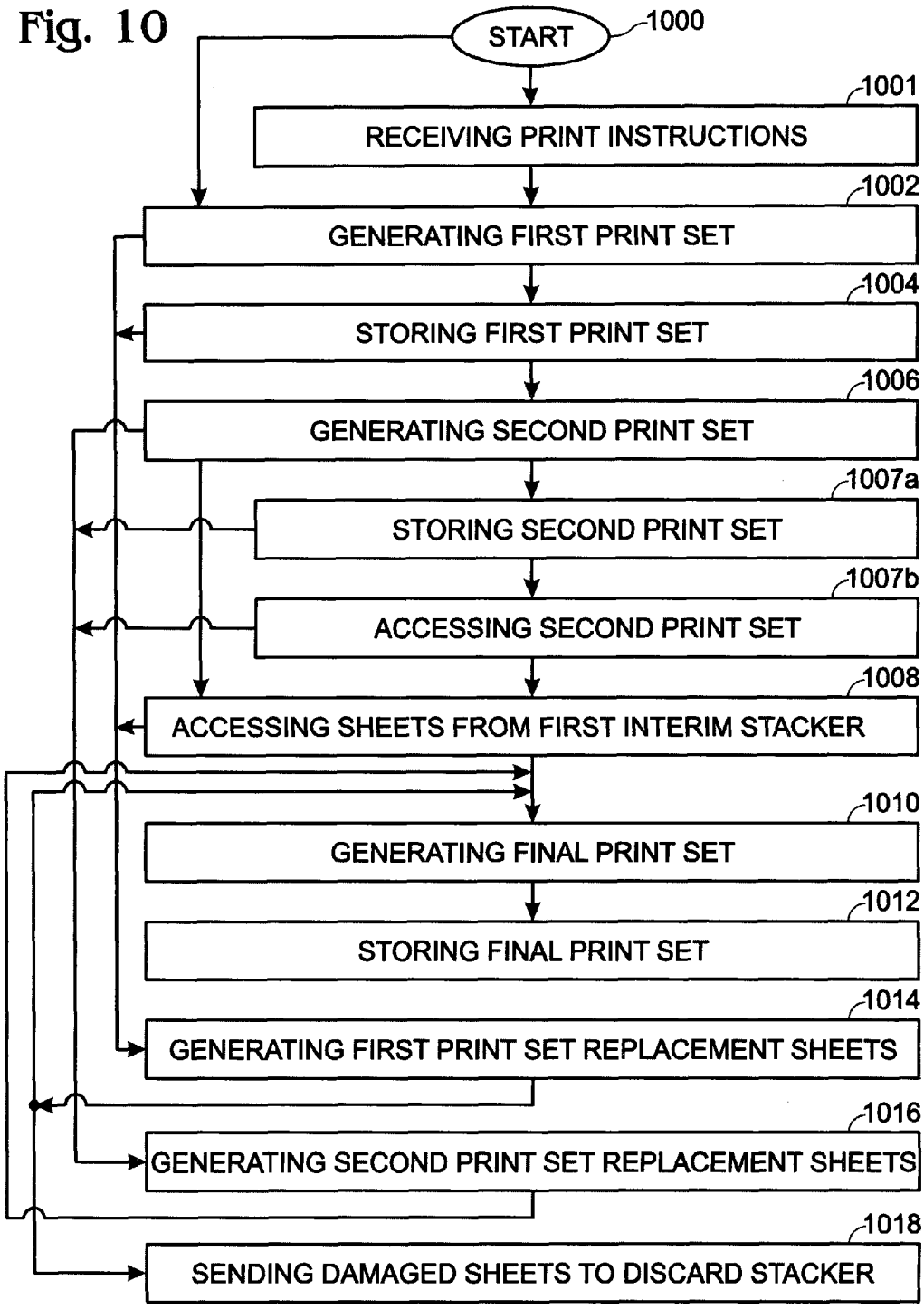
FIG. 10 is a flowchart illustrating a method for recovering from print assembly failure in a printer with printed medium assembly capabilities.

FIG. 10 is a flowchart illustrating a method for recovering from print assembly failure in a printer with printed medium assembly capabilities. Although the method is depicted as a sequence of numbered steps for clarity, the numbering does not necessarily dictate the order of the steps. It should be understood that some of these steps may be skipped, performed in parallel, or performed without the requirement of maintaining a strict order of sequence. The method starts at Step 1000.

Step 1002 generates a first print set including a plurality of physical medium sheets. Step 1004 stores the first print set of a first interim stacker. Step 1006 generates a second print set including a plurality of physical medium sheets. Step 1008 accesses sheets from the first interim stacker. Step 1010 assembles sheets accessed from the first interim stacker, with sheets from the second print set, generating a final print set with a plurality of sheets in a first order. Step 1012 stores the final print set in an output stacker. In the event of a first print set failure, Step 1014 generates first print set replacement sheets. Then, generating the final print set in Step 1010 includes directly merging first print set replacement sheets with sheets from the second print set. In one variation, directly merging the first print set replacement sheets with sheets from the second print set includes sending replacement sheets directly from a print engine to the final output stacker, bypassing the first interim stacker.

In one aspect, generating first print set replacement sheets includes generating replacement sheets in response to a failure such as a failure to initially generate first print set sheets, a failure to store first print set sheets in the first interim stacker, a failure to access first print set sheets from the first interim stacker, or a failure to supply undamaged first print set sheets. In another aspect, first print set replacement sheets are generated in response to a failure to supply undamaged first print set sheets, and a further step, Step 1018 sends damaged first print set sheets to a discard stacker.

In another aspect, Step 1001 receives first print set printing instructions from a first source. Then, generating first print set replacement sheets in Step 1014 includes: determining sheets from the first print set requiring reprinting; sending a replacement message to the first source; and, receiving printing instructions for the generation of the first print set replacement sheets.

In one aspect, generating the first and second print set in Steps 1002 and 1006, respectively, includes generating the first and second print sets from a first print engine. Alternately, Step 1002 generates the first print set from a first print engine, and Step 1006 generates the second print set from a second print engine. If so, first print set replacement sheets can be generated in Step 1014 from the second print engine in response to a first print engine failure.

In a different aspect, Step 1007*a* stores the second print set in a second interim stacker, and Step 1007*b* accesses sheets from the second interim stacker. Then, generating the final print set in Step 1010 includes assembling sheets accessed from the first interim stacker, with sheets accessed from the second interim stacker.

In the event of a second print set failure, Step 1016 generates second print set replacement sheets, and generating the final print set in Step 1010 includes directly merging second print set replacement sheets with sheets from the first print set.

In another aspect, Step 1006 may generate the second print set from a second print engine, and generating second print set replacement sheets in Step 1016 may includes generating second print set replacement sheets from a third print engine.

In a different aspect, generating first print set replacement sheets in Step 1014 includes: generating replacement sheets for the entire first print set; and, storing the replacement sheets in a third interim stacker. Then, directly merging first print set replacement sheets with sheets from the second print set in Step 1010 includes directly merging first print set replacement sheets from the third interim stacker with sheets from the second print set.

A system and method have been presented for recovering from document printing and assembly failures. Some examples of particular bypass paths, print engines, and interim stackers have been given to illustrate the invention. However, the invention is not limited to merely these examples. Other variations and embodiments of the invention will occur to those skilled in the art.

We claim:

1. In a printer with printed medium assembly capabilities, a system for recovering from print assembly failure, the system comprising:

a first print engine having an output connected to a first interim stacker paper path to supply a first print set including a plurality of physical medium sheets, and an output connected to a bypass paper path, the first printer comprising a single printer which is directly connected to both the first interim stacker paper path and the bypass paper path;

a first interim stacker having an input to accept the first print set from the first print engine via the first interim stacker paper path and an output to supply the first print set;

a merger module having an input connected to the first print engine via the bypass paper path, an input to access sheets from the first interim stacker, and an input to accept bypass commands, the merger module accepting a second print set including a plurality of physical medium sheets, which are first print set replacement sheets~assembling sheets accessed from the first interim stacker with sheets from the second print set, and supplying a final print set with a plurality of sheets in a first order;

an output stacker having an input to accept the final print set; a recovery module having an input to accept a failure signal, an output to supply replacement sheet print commands to a print engine, and an output to supply bypass instructions to the merger module in the event of a first print set failure; and wherein the merger module directly merges first print set sheets, with sheets from the second print set, in response to the bypass instructions.

2. The system of claim 1 wherein the first print engine has an input to receive first print set printing instructions from a first source; and, wherein the recovery module determines sheets from the first print set that require reprinting in response to receiving a failure signal, the recovery module sending a failure message to the first source and receiving printing instructions for the generation of the first print set replacement sheets.

3. The system of claim 1 wherein the first print engine supplies the first and second print sets.

4. The system of claim 1 wherein the first print engine generates the first print set; and, the system further comprising:

a second print engine having an output to supply the second print set.

5. The system of claim 4 wherein the first print engine has an output connected to a recovery unit input to supply a print failure signal;

wherein the recovery unit supplies first print set replacement sheet commands in response to a failure to generate first print set sheets; and, wherein the second print engine has an input connected to the recovery unit output, the second print engine supplying first print set replacement sheets in response to first print set replacement sheet commands from the recovery unit.

6. The system of claim 1 further comprising:

a second interim stacker having an output to supply the second print set; and, wherein the merger module has an input connected to the second interim stacker output, the merger module supplying the final print set by accessing sheets from the second interim stacker, and assembling sheets accessed from the first interim stacker, with sheets accessed from the second interim stacker.

7. The system of claim 6 wherein the second interim stacker has an output connected to the recovery unit input to supply a storage failure signal;

wherein the merger module has an output connected to the recovery unit input to supply an access failure signal;

wherein the recovery unit supplies second print set replacement sheet commands and bypass commands in response to receiving a failure signal selected from a group consisting of a failure to generate second print set sheets, a failure to store second print set sheets in the second interim stacker, a failure to access second print set sheets from the second interim stacker, and a failure to supply undamaged second print set sheets; and, wherein the merger module directly merges second print set replacement sheets, with sheets from the first print set, in response to the bypass instructions.

8. The system of claim 7 further comprising:

a second print engine having an output to supply the second print set and an output to supply a print failure signal to the recovery unit;

wherein the recovery unit receives the print failure signal from the second print engine; and, the system further comprising:

a third print engine having an input to receive second print set replacement sheet commands from the recovery unit, and an output connected to the merger module to supply second print set replacement sheets.

9. The system of claim 1 wherein the merger module includes an output connected to the output stacker, for sending first print set replacement sheets directly from the first print engine output, bypassing the first interim stacker.

10. The system of claim 1 further comprising:

a third interim stacker having inputs and outputs for the temporary storage of replacement sheets;

wherein the recovery module supplies replacement sheet commands in response to a failure signal, for generating replacement sheets for the entire first print set and storing the replacement sheets in the third interim stacker; and, wherein the merger module directly merges first print set replacement sheets from the third interim stacker with sheets from the second print set.

11. The system of claim 1 wherein the first print engine has an output connected to a recovery unit input to supply a print failure signal;

wherein the first interim stacker has an output connected to the recovery unit input to supply a storage failure signal;

wherein the merger module has an output connected to the recovery unit input to supply an access failure signal; and, wherein the recovery unit supplies first print set replacement sheet commands and bypass commands in response to a failure signal selected from a group consisting of a failure to initially generate first print set sheets, a failure to store first print set sheets in the first interim stacker, a failure to access first print set sheets from the first interim stacker, and a failure to supply undamaged first print set sheets.

12. The system of claim 11 wherein the recovery unit supplies discard commands in response to a signal indicating a failure to generate undamaged first print set sheets;

the system further comprising:

a discard stacker having an input connected to the first interim stacker output for the storage of damaged first print set sheets; and, wherein the first interim stacker has an input to accept the discard commands, the first interim stacker supplying damaged first print set sheets to the discard stacker, without manually moving the damaged first print set sheets, in response to the discard commands.

13. In a printer with printed medium assembly capabilities, a system for recovering from print assembly failure, the system comprising:

a first print engine having an output to supply a first print set including a plurality of physical medium sheets, the first printer comprising a single printer which is additionally provided with a bypass paper path;

a first interim stacker having an input to accept the first print set from the first print engine and an output to supply the first print set;

a merger module having an input to accept a second print set including a plurality of physical medium sheet, an input to access sheets from the first interim stacker, and an input to accept bypass commands, the merger module assembling sheets accessed from the first interim stacker, with sheets from the second print set, and supplying a final print set with a plurality of sheets in a first order;

an output stacker having an input to accept the final print set; a recovery module having an input to accept a failure signal, an output to supply replacement sheet print commands to a print engine, and an output to supply bypass instructions to the merger module in the event of a first print set failure; and, wherein the merger module directly merges first print set replacement sheets, with sheets from the second print set, in response to the bypass instructions;

a discard stacker having an input connected to the first interim stacker output for the storage of damaged first print set sheets; and, wherein the recovery unit supplies discard commands in response to a signal indicating a failure to generate undamaged first print set sheets; and, wherein the first interim stacker has an input to accept the discard commands, the first interim stacker supplying damaged first print set sheets to the discard stacker, without manually moving the damaged first print set sheets, in response to the discard commands.

14. A system for recovering from print assembly failure, the system comprising:

a printer including:

a port to receive bypass instructions and replacement sheet commands, and to supply failure signals;

a first print engine having an output connected to a first interim stacker paper path to supply a first print set including a plurality of physical medium sheets, and an output connected to a bypass paper path, the first printer comprising a single printer which is directly connected to both the first interim stacker paper path and the bypass paper path;

a first interim stacker having an input to accept the first print set from the first print engine via the first interim stacker paper path and an output to supply the first print set;

a merger module having an input connected to the first print engine via the bypass paper path, an input to access sheets from the first interim stacker, and an input to accept bypass commands, the merger module accepting a second print set including a plurality of physical medium sheets, which are first print set replacement sheets, assembling sheets accessed from the first interim stacker with sheets from the second print set, and supplying a final print set with a plurality of sheets in a first order;

an output stacker having an input to accept the final print set;

a client recovery module having an input to accept failure signals, an output to supply replacement sheet print commands to a print engine, and an output to supply bypass instructions to the merger module in the event of a first print set failure; and, wherein the merger module directly merges first print set replacement sheets, with sheets from the second print set, in response to the bypass instructions.

* * * * *